US009763510B1

(12) United States Patent
Miner

(10) Patent No.: US 9,763,510 B1
(45) Date of Patent: Sep. 19, 2017

(54) MAGNETIC HARNESS FOR RECEIVING TOOLS

(71) Applicant: MAG-VEST, LLC, Overland Park, KS (US)

(72) Inventor: Grant Michael Miner, Overland Park, KS (US)

(73) Assignee: Mag-Vest, LLC, Overland Park, KS (US)

( * ) Notice: Subject to any disclaimer, the term of this patent is extended or adjusted under 35 U.S.C. 154(b) by 0 days.

(21) Appl. No.: 15/078,572

(22) Filed: Mar. 23, 2016

Related U.S. Application Data

(60) Provisional application No. 62/136,944, filed on Mar. 23, 2015.

(51) Int. Cl.

| | |
|---|---|
| ***A45F 5/02*** | (2006.01) |
| ***H01F 7/02*** | (2006.01) |
| ***A41D 13/00*** | (2006.01) |
| ***A41F 1/00*** | (2006.01) |
| ***B25H 3/00*** | (2006.01) |

(52) U.S. Cl.
CPC ..... *A45F 5/02* (2013.01); *A41F 1/002* (2013.01); *B25H 3/00* (2013.01); *A41D 13/0012* (2013.01); *A45F 2200/0575* (2013.01); *H01F 7/0252* (2013.01)

(58) Field of Classification Search
CPC .... A45F 5/00; A45F 5/02; A45F 5/021; A45F 2200/0575; H01F 7/0252; A41D 13/0012
USPC ..... 224/183
See application file for complete search history.

(56) References Cited

U.S. PATENT DOCUMENTS

| | | | | |
|---|---|---|---|---|
| 2,540,340 A | | 2/1951 | Linblade | |
| 3,665,355 A | | 5/1972 | Sasaki et al. | |
| 3,886,508 A | | 5/1975 | Lavrard et al. | |
| 4,733,808 A | | 3/1988 | Turner et al. | |
| 4,826,059 A | | 5/1989 | Bosch et al. | |
| 5,196,818 A | * | 3/1993 | Anderson | A45F 5/00 223/109 A |
| 5,307,582 A | | 5/1994 | Quintel et al. | |
| 5,333,767 A | * | 8/1994 | Anderson | A45F 5/00 223/109 A |
| 5,496,358 A | | 3/1996 | Rosenwald et al. | |
| 5,593,073 A | | 1/1997 | Finnegan | |
| 5,682,653 A | * | 11/1997 | Berglof | G09F 1/10 224/183 |
| 5,740,557 A | | 4/1998 | Reid et al. | |
| 5,760,668 A | * | 6/1998 | Testa | B25H 3/04 206/350 |
| 6,050,931 A | | 4/2000 | Russell | |
| 6,052,828 A | | 4/2000 | Widdemer et al. | |
| 6,530,508 B1 | | 3/2003 | Devine | |

(Continued)

*Primary Examiner* — Justin Larson
(74) *Attorney, Agent, or Firm* — Lathrop Gage LLP

(57) ABSTRACT

A magnetic harness for holding magnetically attractable metallic work items there against for convenient access is described. The harness includes an elongated pocket that holds a plurality of magnets. The plurality of magnets are attached side by side and one atop the other to increase the strength of the magnetic field or attractability of the magnets. The pocket is easily accessible to the user to allow the user to manually manipulate the strength of the magnetic field by increasing or decreasing the amount of magnets in the pocket. The harness includes a series of elongated pockets across the front of the harness.

18 Claims, 11 Drawing Sheets

(56) References Cited

U.S. PATENT DOCUMENTS 6,568,574 B2 5/2003 Jones et al.
6,571,997 B2 * 6/2003 Dedrick ..... A45F 5/00 224/183
6,587,022 B1 7/2003 Devine
6,611,180 B1 8/2003 Puzella et al.
6,643,845 B2 * 11/2003 O'Dea ..... A41D 19/01594 2/160
6,675,965 B2 * 1/2004 Holland ..... A45F 5/02 206/338
6,772,925 B2 * 8/2004 O'Hare ..... A45F 3/08 2/102
6,779,199 B1 * 8/2004 O'Dea ..... A41D 19/01594 2/160
7,146,651 B1 12/2006 Lapin
7,817,002 B2 10/2010 Fullerton et al.
8,403,140 B2 3/2013 Woolery
8,516,621 B2 * 8/2013 Woolery ..... A41D 13/0012 2/300
8,727,189 B2 * 5/2014 Zieman ..... D05B 91/00 223/109 A
9,343,214 B2 * 5/2016 Mathieu ..... H01F 7/0252
2001/0006161 A1 7/2001 Tulchinskiy
2003/0071095 A1 * 4/2003 Dedrick ..... A45F 5/00 224/183
2003/0230606 A1 * 12/2003 Devinie ..... A45F 5/00 224/183
2004/0173484 A1 9/2004 Bates et al.
2004/0256335 A1 12/2004 Sholem
2005/0040194 A1 2/2005 Frye et al.
2005/0082323 A1 4/2005 O'Hair
2005/0280488 A1 * 12/2005 Devine ..... A45F 5/00 335/306
2006/0016841 A1 1/2006 Shurm
2007/0006367 A1 1/2007 Newman
2007/0214550 A1 9/2007 Bongiovanni
2008/0185414 A1 * 8/2008 Conlon ..... A45F 5/02 224/674
2009/0050657 A1 * 2/2009 Woolery ..... A45F 3/14 224/183
2010/0005562 A1 1/2010 Park
2010/0025442 A1 2/2010 Shurm
2014/0026297 A1 1/2014 Enes
2014/0054474 A1 2/2014 Rees
2015/0305478 A1 * 10/2015 Krol ..... A45F 3/14 224/148.6
2016/0242534 A1 * 8/2016 Mathieu ..... H01F 7/0252
2016/0331053 A1 * 11/2016 Gordon ..... A41D 27/205
2017/0112266 A1 * 4/2017 Constanzo ..... A45F 3/14

* cited by examiner

MAGNETIC HARNESS FOR RECEIVING TOOLS

CROSS REFERENCE TO RELATED APPLICATIONS

This application claims the benefit of U.S. Provisional Application No. 62/136,944, filed Mar. 23, 2015, the entity of which is incorporated by reference herein.

BACKGROUND OF THE INVENTION

The present invention relates, in general, to magnets and clothing and, more particularly, to a magnetic harness which enables at least one metal object to be easily coupled to a vest, armband, gown, or other article of clothing and easily removed from each other.

It has been proposed to provide workers with a means to attach tools while not being used or not in a resting place elsewhere in the work area. Such means have included pockets of a work garment for carrying tools, loop-shaped straps on garments or belts for retaining tools, gloves with a magnet to hold nails or small tools to the finger of the wearer, and garments with magnets permanently placed in individual pockets such that the magnets are separated from one another and not removable. Loop-shaped straps are useful only for tools of a specific range of size. Tools which exceed a certain dimension cannot be inserted in a given pocket or loop, and tools smaller than the dimension of a loop are not retained. These arrangements are also unsatisfactory in that it is relatively time-consuming to insert a tool into a pocket or the loop of a strap, and equally inconvenient to withdraw the tool.

Contrary to the inherent mode of operation of pockets and straps, magnets need not be approached by the tool in any specific direction. Permanent magnets emit a magnetic field without the need for any external source of magnetism or electrical power. Temporary magnets behave as magnets while attached to or close to something that emits a magnetic field, but lose this characteristic when the source of the magnetic field is removed. Electro-magnets require electricity in order to behave as a magnet. Rare Earth magnets are magnets that are made out of the Rare Earth group of elements. The most common Rare Earth magnets are the Neodymium-Iron-Boron and Samarium Cobalt types.

A metallic tool is readily secured to the magnet by merely moving it close to the magnets, and may be withdrawn from the tool holder in a similarly simple manner. The tools magnetically retained may not be dropped accidentally in the manner always possible with pockets or straps if the workman bends low so that the opening of the pocket or strap faces downward. It has now been found that the shortcomings of known tool holders arranged to be fastened to a portion of an adult body can be avoided by providing a group of magnets of which each is separated by another magnet of the group, and which jointly define an accessible engagement surface. The groups of magnets are sewn or otherwise permanently enclosed into the material of the clothing, and this has practical drawbacks; once sewn in, the magnets are difficult or impossible to remove, and therefore do not allow for a change in the magnetic field or force on the fly to accomplish holding a variety of tools.

Therefore, a magnetic structure which can facilitate coupling or removal of magnetics to deal with different needs of the user is required.

BRIEF SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

One embodiment of the present invention provides a magnetic harness for use as a tool and parts holder. The magnetic harness can be used by mechanics, plumbers, oil drillers, or the like, to hold tools, such as screwdrivers, pliers, or wrenches; by office workers for office tools such as scissors and letter openers; by dentists and doctors for holding the tools of their trade; restaurant or household workers for tools, i.e. kitchen or garden; and by sports enthusiasts, including underwater activities such as holding scuba diving tools. The use of the word "tool" throughout the specification and claims includes any metallic object. Such objects can include hand-held tools, industrial tools, parts, and hardware (nails, nuts, bolts, paperclips, and the like). The use of the term "metal" or "metallic" throughout the specification and claims means any material, metal or alloy which is attracted to a magnet.

One embodiment of the present invention provides a garment having a magnetic portion having at least one resealable pouch housing at least one magnet, the pouch having an internal surface being sized and shaped to allow within said pouch a plurality of magnets to be situated by at least one of: along a longitudinal axis and stacked so as to engage one another and traverse the longitudinal axis and side by side so as to engage one another. The plurality of magnets form a magnetic engagement surface to allow a fastening means to support a metallic object. The magnets may be various sizes and shapes, including, but not limited to square, rectangular, and circular. The magnet is selected from the group consisting of permanent magnets, ferromagnets, alnico magnets, rare earth magnets, injection molded magnets, flexible magnets, ceramic magnets, and electromagnets. The magnetic portion may be on the interior or exterior of the garment.

In one embodiment, the magnets may be situated side by side traverse to a longitudinal axis with the poles of the magnets aligned about the longitudinal axis. In another embodiment a two dimensional array of magnets is envisioned, wherein the magnets are stacked in a longitudinal direction and then situated side by side engaging each the respective neighbor magnet.

In another embodiment, the magnet includes a fastening means, such as hook and loop material to couple to the internal surface of the pouch.

In another embodiment, the further includes a sealable water resistant layer that couples to the internal surface of the pouch, and wherein the sealable water resistant layer maintains an alignment of the plurality of magnets.

In another embodiment, the garment includes a belt, the belt being coupled to the fastener to allow for various sizing of the wearer.

In another embodiment, the garment further includes a plurality of pockets of various shapes and sizes on an outer surface thereof, clips of various shapes and sizes, and loops of various shapes and sizes.

In a method of affecting the magnetic strength of a magnet in a magnet holding garment according to the present invention, including the steps of: providing a garment with a magnetic attractive portion, the magnetic portion having an open accessible pocket with at least one magnet within the pocket; manipulating the magnetic strength of the at least one magnet within the pocket; and attaching a metallic object to the magnetic attractive portion of the gown. Wherein, manipulating the magnetic strength of the at least one magnet within the pocket can be accomplished by either increasing or decreasing the strength. To increase the strength a second magnet is added to the at least one magnet by means of either one of one magnet atop the respective other or by coupling the respective magnets side by side. In another embodiment, it may be both stacking and coupling magnets side by side to form a two dimensional array. To decrease the strength, a magnet is removed from the at least one magnet within the pouch. The pouch being sized and shaped to accommodate these changes, as well, as being sealed and opened again to allow for manipulation. In one embodiment, the pouch is attached to the garment on three sides allow at least one side to be open to allow for manipulation of the magnetic strength.

In another embodiment, the magnetic attractive portion includes a plurality of pouches.

In another embodiment, the pouch includes an interior layer that is sealable and water resistant.

The drawings constitute a part of this specification and include exemplary embodiments of the present invention and illustrate various objects and features thereof.

BRIEF DESCRIPTION OF THE DRAWINGS

A further understanding of the invention may be had by reference to the accompanying drawing in which.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. It is also noted that any reference to the words top, bottom, up and down, and the like, in this application refers to the alignment shown in the various drawings, as well as the normal connotations applied to such devices.

A magnet is a material or object that produces a magnetic field which is a vector field that has a direction and a magnitude (also called strength). The illustrated FIGS. 1-3 are various illustrations to explain different concepts about magnetic technology, which can be utilized in an embodiment of the present invention.

Figure 1:
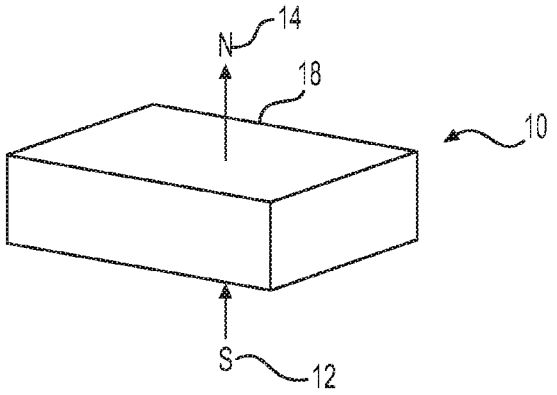
FIG. 1 is a top perspective view of a bar or block magnets with an anisotropic magnetic north on the top and a magnetic south on the bottom to an embodiment of the present invention.

Referring to FIG. 1, there is illustrated an exemplary block or bar magnet 10*a* which has a South pole 12 and a North pole 14 and magnetic field vectors that represent the direction and magnitude of a magnet's moment 18. The magnet moment 18 is a vector that characterizes the overall magnetic properties of the magnet 10. For the bar magnet 10 illustrated, the direction of the magnetic moment points 18 from the South pole 12 to the North pole 14. The North and South poles 14, 12 are also referred as positive (+) and negative (−) poles or polarity, respectively.

Two magnets aligned such that their polarities are the same (not shown) direction (i.e. North aligned with North) results in a repelling spatial force (not shown) which causes the two magnets to repel each other. In contrast, FIGS. 2-3, depicts two magnets 10*a* and 10*b* that are aligned such that their polarities are in opposite resulting in an attracting spatial force which causes the two magnets 10*a* and 10*b* to attract (stick) to each other.

Figure 2:
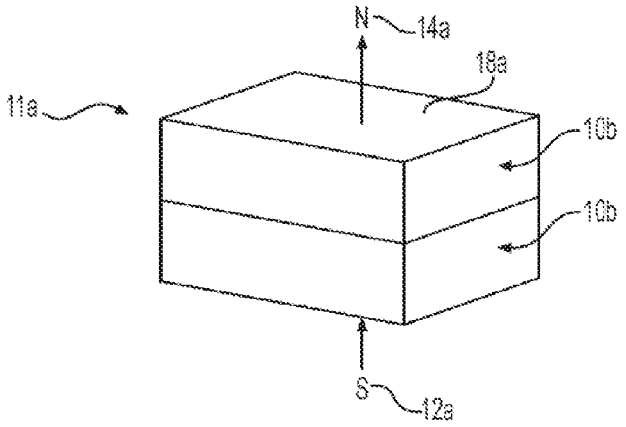
FIG. 2 is a top perspective view of two bar or block magnets with an anisotropic magnetic north on the top and a magnetic south on the bottom situated one on top of the other according to an embodiment of the present invention.
Figure 3:
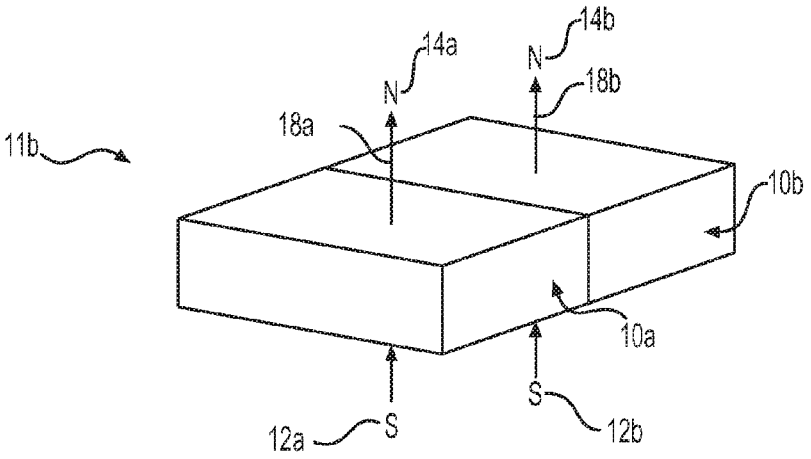
FIG. 3 is a top perspective view of two bar or block magnets with an anisotropic magnetic north on the top and a magnetic south on the bottom situated side by side according to an embodiment of the present invention.

In FIG. 2, the magnets 10*a* and 10*b* are illustrated as being aligned with one another one a top the other as a single magnet 11*a*, where they "stick" to each other and maintain their positions relative to each other unless a sliding force is used to disengage them.

FIG. 3 illustrates the magnets 10*a* and 10*b* as being aligned with one another one side by side, where they "stick" to each other and maintain their positions relative to each other unless a sliding force is used to disengage them. The power or strength of the combined magnets 10*a*, 10*b* will increase in a ratio with which the size of the overall magnet 11*b* increases, even if the strength of the magnets 10*a*, 10*b* are different. If the two magnets are stacked together on atop the other or side by side (with opposite poles touching), as a close approximation, the magnets 10*a*, 10*b* will act like a single magnet 11*a*, 11*b* of the same overall dimension (FIG. 2). This is a close approximation because the stacked or side by side magnets have slightly less magnet material in-between each other that would not be the case for a single magnet. As more and more magnets are stacked together one atop the other, they receive diminishing returns but an increase is still seen. The more magnets 10*a*, 10*b* that are stacked up (not shown), the less increase in pull force. Therefore, the better solution is to have stacks of magnets 10*a*, 10*b* in an elongate pattern, i.e. side by side, to increase the overall strength of the magnets 10*a*, 10*b*, or in a way combining the illustrated patterns seen in FIGS. 2 and 3.

It will be appreciated that FIGS. 4-13 teach by way of example and not limitation. The number of apparatus components may be increased or decreased with respect to what is shown. In one such example, further pockets 35, loops 36, magnets 20, and further magnet pockets 21 may be incorporated into an apparatus.

Figure 4:
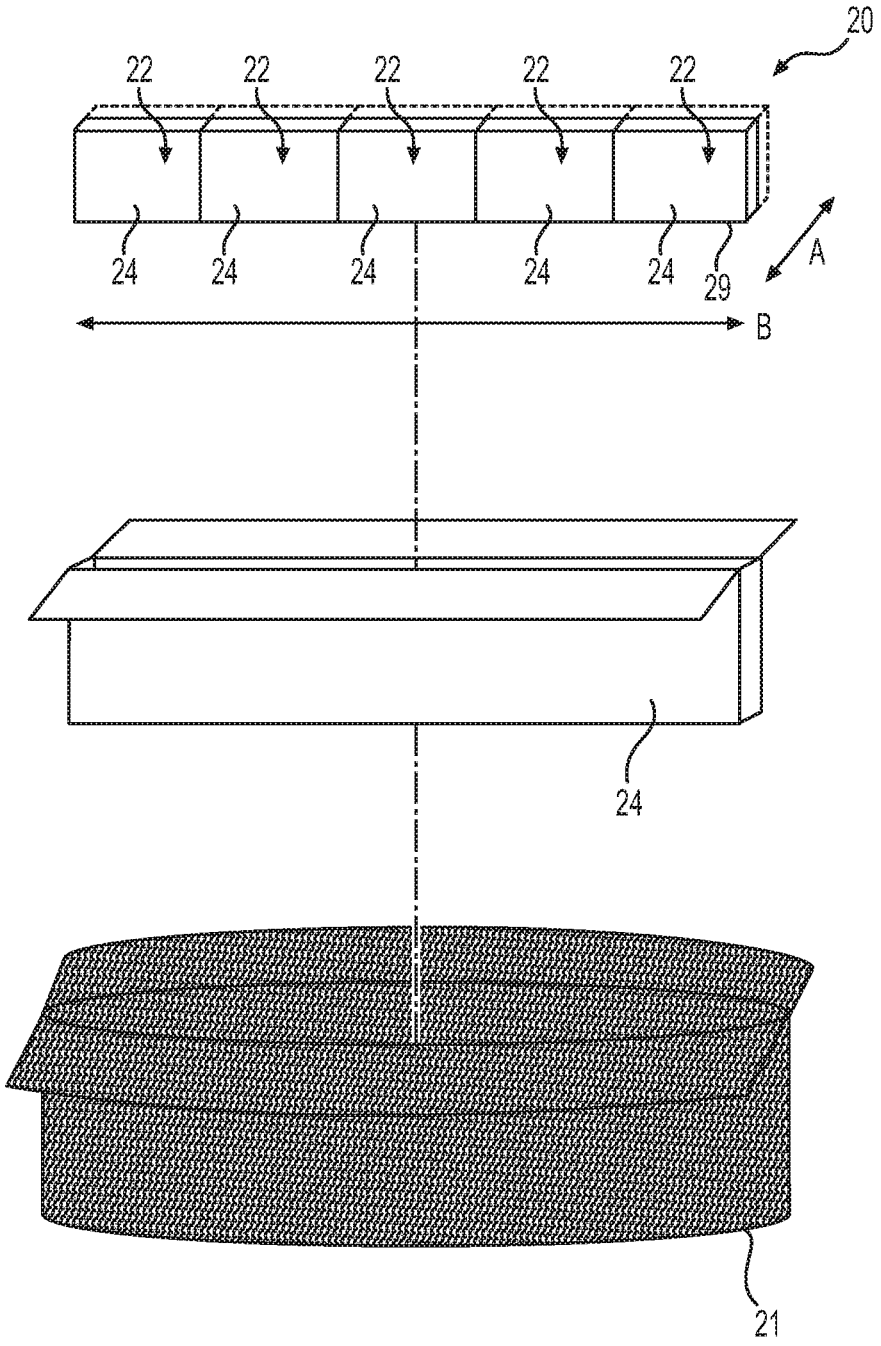
FIG. 4 is an exploded view of the interior magnetic pouch, water proof sealing, and set of magnets according to an embodiment of the present invention.
Figure 5:
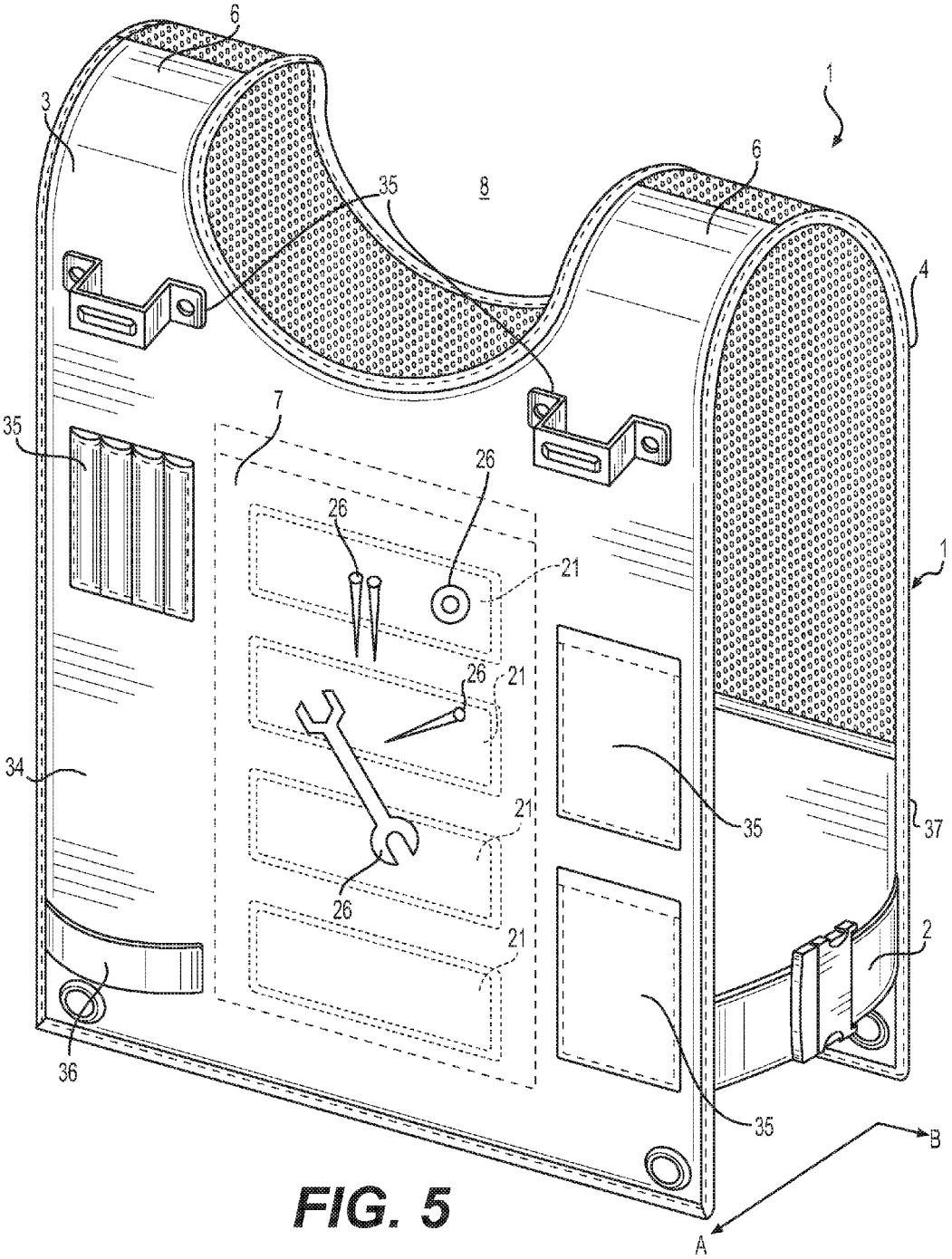
FIG. 5 is a top perspective view of a magnetic vest according to an embodiment of the present invention.
Figure 6:
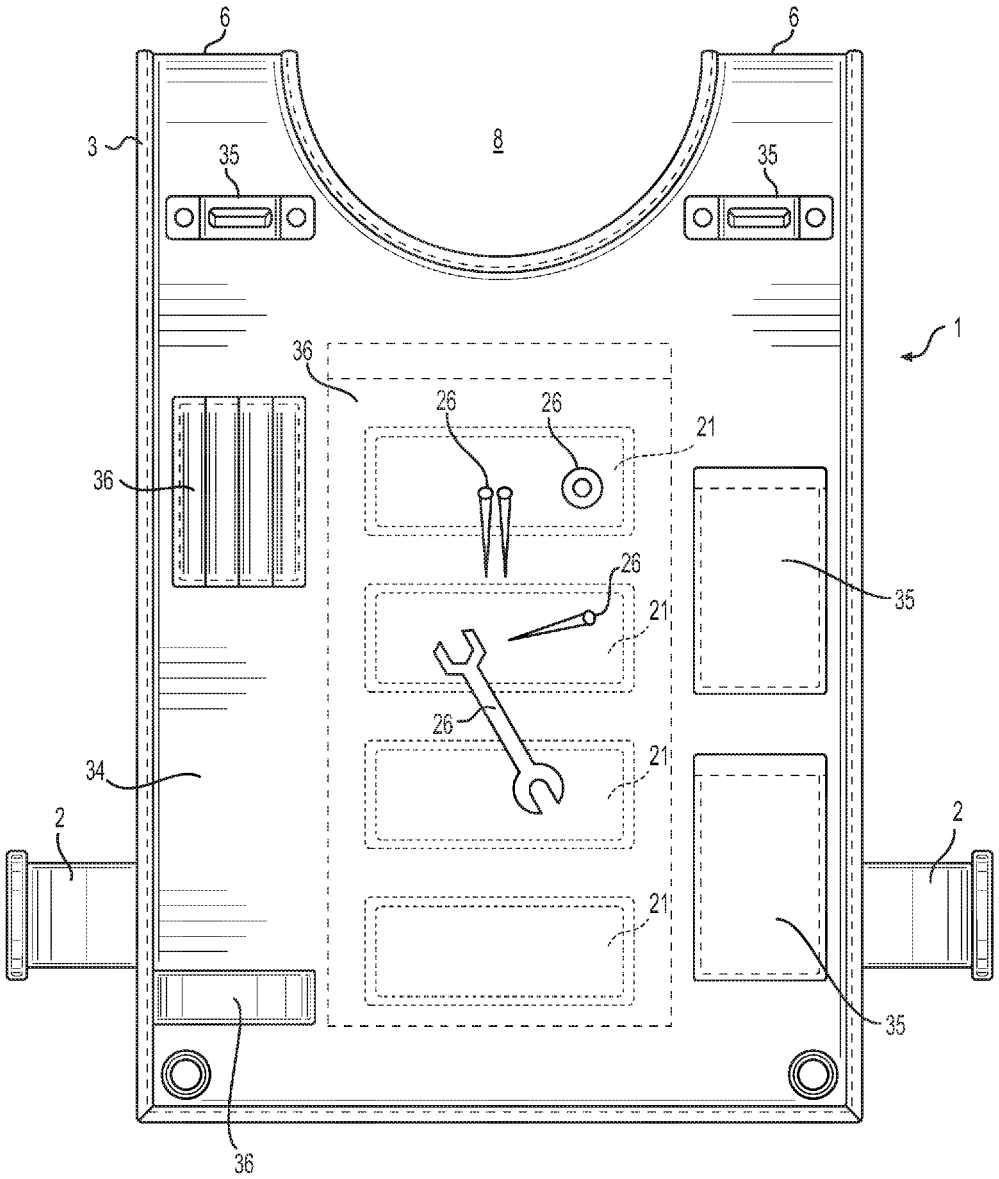
FIG. 6 is a front view of the magnetic harness of FIG. 4 according to an embodiment of the present invention.
Figure 7:
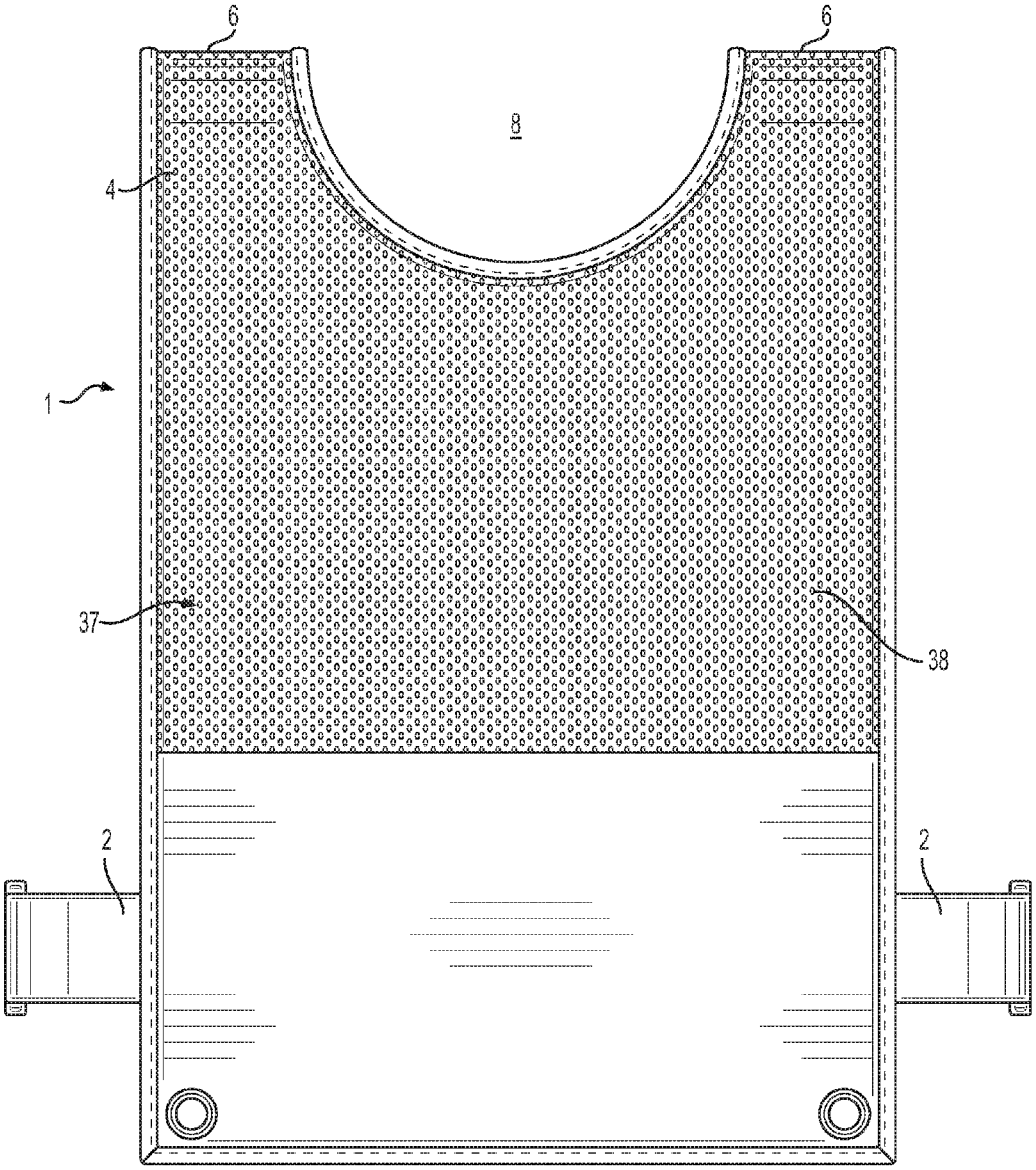
FIG. 7 is a back view of the magnetic harness of FIG. 4 according to an embodiment of the present invention.
Figure 8:
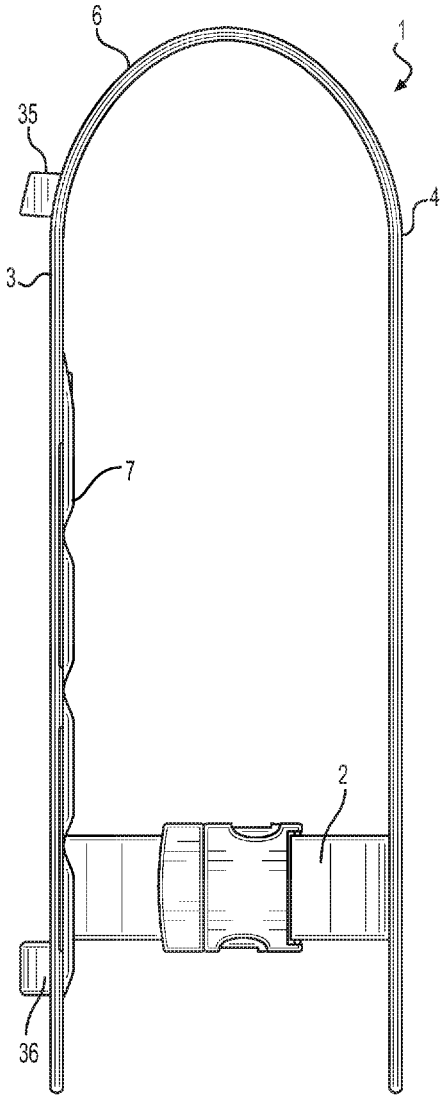
FIG. 8 is a side view of the magnetic harness of FIG. 4 according to an embodiment of the present invention.
Figure 9:
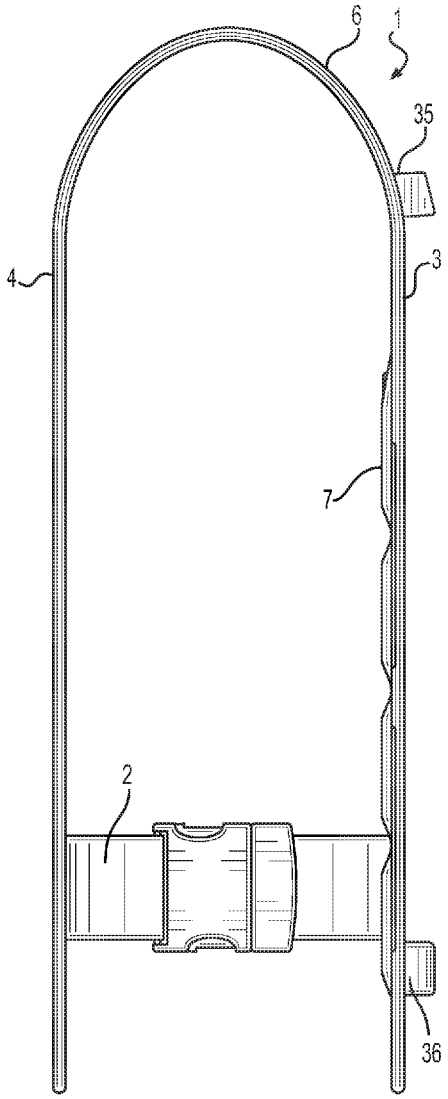
FIG. 9 is another side view of the magnetic harness of FIG. 4 according to an embodiment of the present invention.
Figure 10:
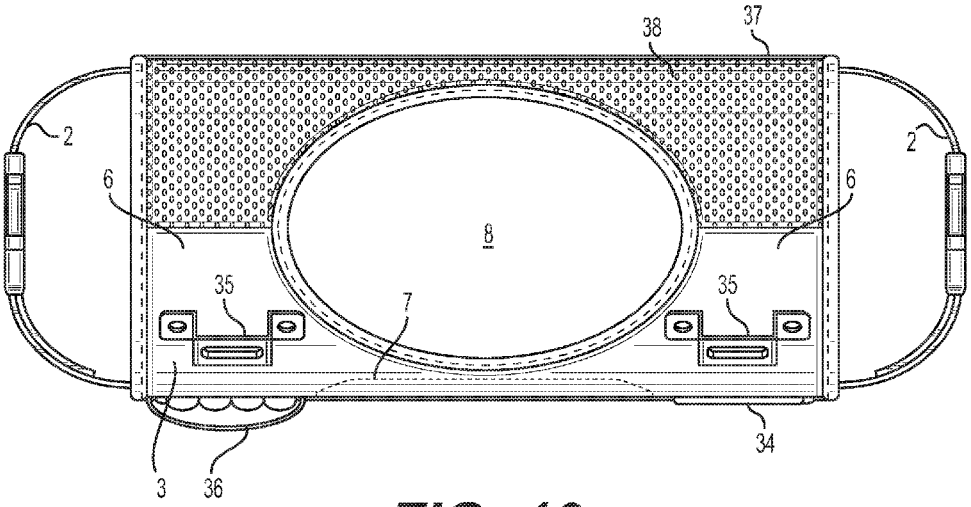
FIG. 10 is a top view of the magnetic harness of FIG. 4 according to an embodiment of the present invention.
Figure 11:
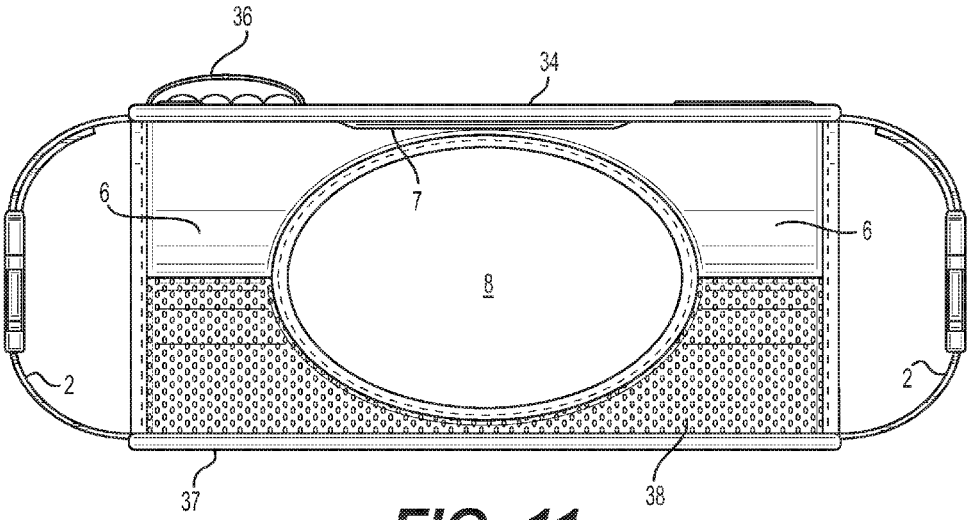
FIG. 11 is a bottom view of the magnetic harness of FIG. 4 according to an embodiment of the present invention.
Figure 12:
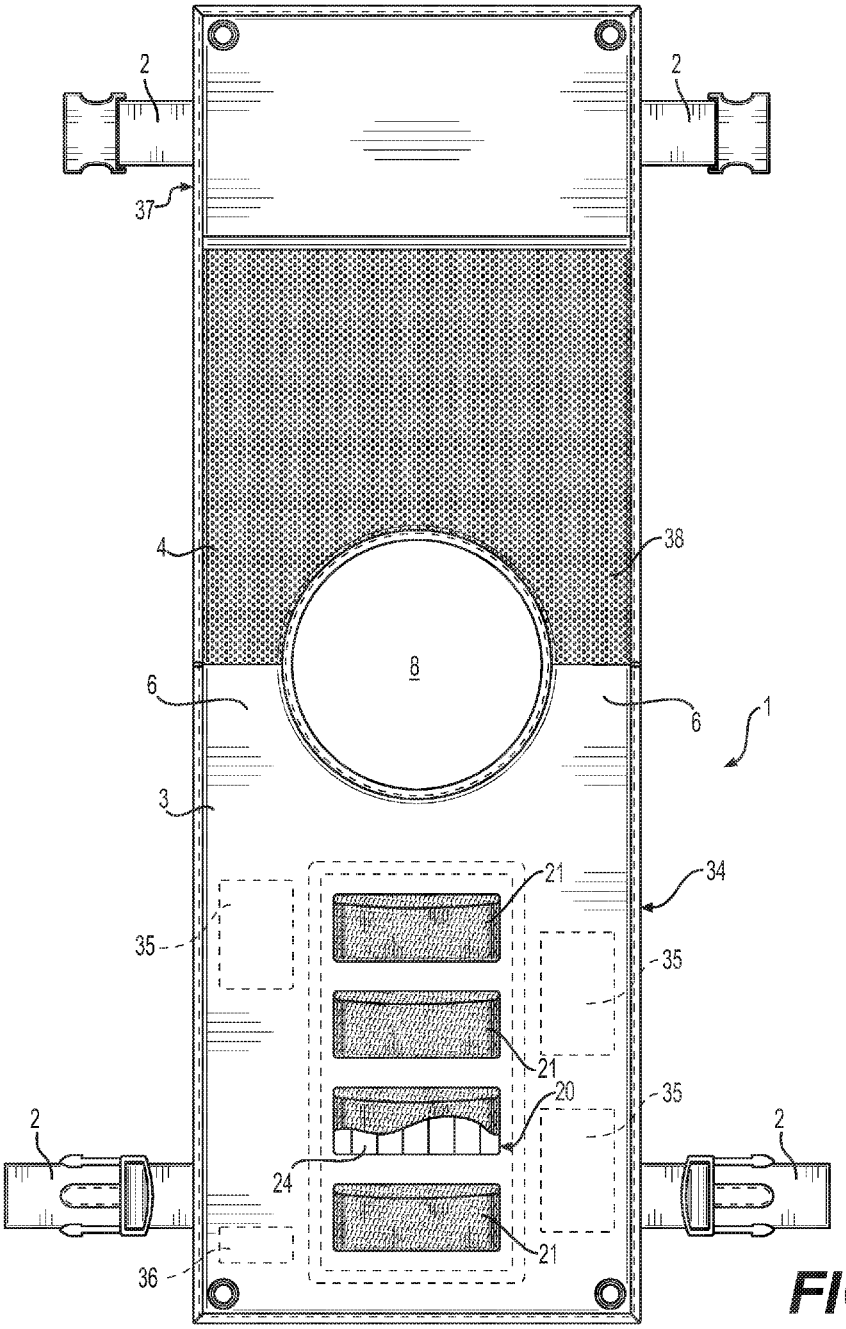
FIG. 12 is a top view of the magnetic harness of FIG. 4 laid out according to an embodiment of the present invention.

Referring to FIGS. 5-11, there is illustrated a sleeveless vest or harness 1 essentially consisting of a belt 2, an integral front portion 3, an integral back portion 4, two shoulder straps 6 integral with the front and back portion 3, 4, and an interior magnet holding portion 7 capable of holding at least one set of magnets 20 (FIG. 4). In the preferred embodiment, the harness 1 is worn on the outside of clothing, but it is foreseen that the harness 1 may be worn under clothing, as well.

The belt 2 may be a single piece interwoven between the front portion 3 and the back portion 4 or it may be two separate pieces. The belt 2 may be fastened about the trunk of the wearer by means of a buckle or fastener 13, such as a hook and loop material. The belt 2 may consist of fabric, flexible leather, or soft plastic and it will be appreciated that the exact nature of the materials of construction employed in the supporting structure is not critical.

The two shoulder straps 6 define with the front and back portions 3, 4 an opening 8 through which the neck of a wearer normally passes. It is foreseen that the straps 6 may include have free ends (not shown), which are fixedly fastened to either the front or back portions 3, 4. It is foreseen that the harness may not include a back portion 4, wherein the straps 6 would tie or otherwise attach around the neck of a user.

The harness 1 illustrated in FIGS. 4-12 includes pockets 35 that are attached to a front outer surface 34 of the front portion 3 to hold various objects such as plastic or non-metallic parts, rubber washers, wooden objects such as pencils, or measuring devices such as rulers. It is foreseen that the pockets 35 could also be clips or clip on attachments. Pockets 35 could also be used to hold bulky items such as tape measurers, rolls of adhesive tape or a work cloth and come in various shapes and sizes. The harness 1 also includes a loop 36 that is attached to at least one of the front outer surface 34 and a back outer surface 37. Pockets 35 and loop 36 are merely illustrative of other conventional receptacles, which the harness 1 may have in addition to the magnetic tool retaining device of the invention.

Referring to FIG. 4, the magnet holding portion 7 includes several sets of magnets 20, in the illustrated example, there are four sets of magnets 20 in individual re-sealable pouches, cavities, pockets 21. It is foreseen there may be more or less pockets 21 in the present invention. It is also foreseen that the interior magnet holding portion 7 may incorporate a single re-sealable pocket (not shown), with multiple cavities to install separate arrays or magnets 22, each cavity large enough to hold an array of magnets, as well, as a sealable layer (see FIG. 4).

A pocket 21 is sewn or otherwise attached to the interior of front portion 3 to situate the magnet bars 22 therein. It is foreseen that the pouches 21 may be attached by a hook and loop fastening system or some combination thereof with some being sewn, heat sealed, pressure sealed, and some being attached by hook and loop fasteners. In the preferred embodiment the pouch is located on the interior of the front portion 3, but it is also foreseen that the pouches 21 may be located on the exterior of the front portion 3. It is foreseen that the pockets or pouches 21 may be different heights, width, and thickness to allow for a variety of different combinations of magnets 22 in a variety of different combinations. In the illustrated example the magnet holding portion 7 further includes a water proof or resistant sealable layer 24, wherein the aligned magnets may be enclosed in. It is foreseen that the sealable layer 24 may be removeably situated within the pocket 21 or permanently attached to the pocket 21. The sealable layer 24 prevents the magnets 22 from moving around within the pocket 21, and is meant to maintain the array of magnets 22 in a proper alignment Each set of magnets 20 comprises a plurality of juxtaposed (side by side) magnetic bars 22 which are positioned in the interior portion 7 of the front portion 3 inside a pouch 21, the polarity of the magnets 20 are such that the magnetic bars 22 will attract metal on both the front face 24 and the rear face (not shown) of the magnetic bar 22. The magnet 22 inserted is assumed to have one pole on each face, such that the direction of a pole is situated towards the at least one of front portion 3 and the back portion 4 facing inwardly and outwardly in a longitudinal direction or axis A. It is foreseen that the bottom surface 29 of the magnet bars 22 may have a hook material and a bottom interior surface of either the pocket 21 or a sealable layer 24 may have a loop material to attach the magnet to the material or vice versa. The magnet bars 22 are uniformly situated in a transverse direction B to the front and back faces and are slightly more than 1 inch distance from another set of magnets 20. It is foreseen that the set of magnets 20 may come in different configurations, for example, a double set or a two dimensional array of magnets 20 is envisioned (not shown), wherein the set of magnets 20 extends in both directions A and B. These configurations would allow for a greater magnetic pull either across the entire array or if only needed more on a particular side, then stacking magnets 22 atop one another on the requisite side is envisioned, and the pocket 21 is envisioned to be sized and shaped to allow for this. It is foreseen that a rubber spacer (not shown) may create spaces in-between the magnets.

The front face 24 of the magnet 20, and thereby the front portion 3 is used to hold various tools 26. Tools 26 having an approximately flat surface automatically orient themselves in such a manner that their flat surface is adjacent the maximum possible number of magnet poles. Each magnet bar 22 is identical in shape and in strength. Preferably, magnets 22 are of the rare earth hard, permanent type such as Neodymium Iron Boron (NdFeB) magnets, but other types of hard magnets may be used alone or in combination with NdFeB magnets, such as Samarium Cobalt (SmCo), Aluminum Nickel Cobalt (AlNiCo), Ferrite, or Ferrite/Ceramic magnets. Also, it is foreseen to use flexible magnets to replace the hard magnets. Furthermore, although magnets 22 are rectangular, magnets 22 may be round, square, or any other shape. It is foreseen that different strengths may be introduced into the set of magnets 20. It is also foreseen that the harness can be attached to and easily slide away from a mounting surface (not shown).

The array of magnets 20 being aligned cannot wrap or fold themselves about a cylindrically arcuate surface (not shown) of a retained tool 26, but such a surface has been found to orient itself automatically in such a manner that it is engaged by more than one adjacent magnet 22. Although the drawing shows magnetic bars 22 having sharp edges, the edges may be rounded or smoothed to facilitate the insertion. The harness 1 may consist of strong flexible fabric that will contour to the shape of the wearer. Flexible materials which are useful for the harness 1 include, but are not limited to, leather, mesh, denim, simulated leather, plastic and cloth or some combination of the like. In the illustrated example, the front and back surfaces 34, 37 are not made of the same material, wherein the back surface includes a mesh fabric 38. It is foreseen that some of the material selected for the harness 1 may also be an insulative material, such as polycarbonate, for placement of the holder on a hot or electrically conductive mounting surface. Such a material would prevent the tools from getting hot and could also offer protection for the user against the heat or electrical conductivity of the environment.

Figure 13:
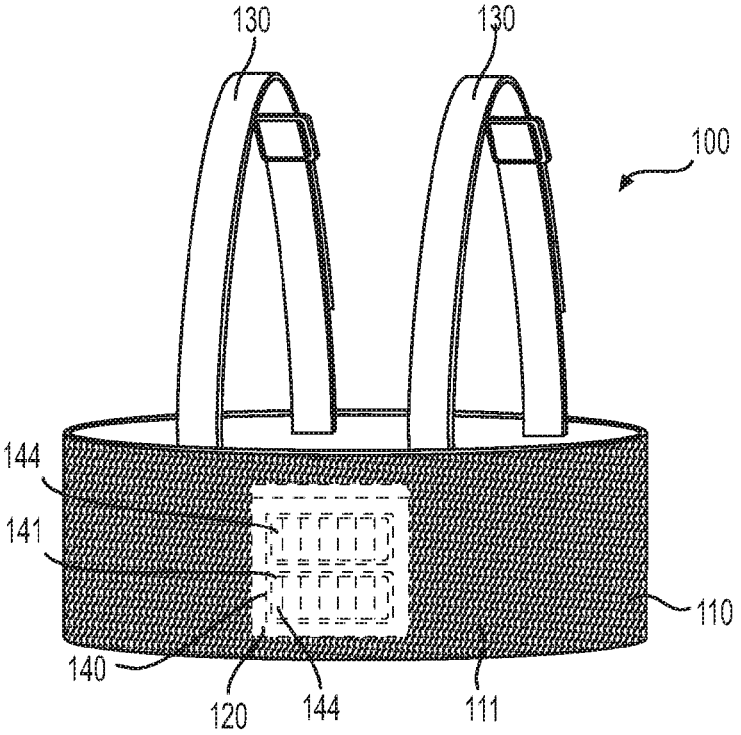
FIG. 13 is a top perspective view of a magnetic harness according to a second embodiment of the present invention.

In accordance with another embodiment of the present invention, FIG. 13 illustrates a chest strap 100 having a strap portion 110, a magnetic attractive portion 120, and straps 130 to go around a wearer's shoulder (not shown). The magnetic attractive portion 120 is defined by a plurality of magnets 140 within pockets 141 disposed in chest strap 100 in an array such that each magnet 144 is contiguous with another magnet 144, as described above. The magnetic attractive portion 120 of chest strap 100 functions in a similar manner as the interior magnet holding portion 7 of harness 1 as described above. It is foreseen that the magnetic attractive portion 120 may be attached to the strap portion 110 by means of a hook and loop fastener, allowing the user the ability to place the magnetic means anywhere that is best suited for the task at hand. The strap portion 110 may include a pockets (not shown) and/or loop(s) (not shown) which are attached to the front outer surface 111 of the strap portion 110 to hold various objects such as plastic or non-metallic parts, rubber washers, wooden objects such as pencils, or measuring devices such as rulers. The strap portion 110 could also include a slit (not shown) for holding such objects. In the preferred embodiment, the chest strap 100 is worn underneath clothing, but it is foreseen that the chest strap 100 may be worn on the exterior of clothing, as well.

Figure 14:
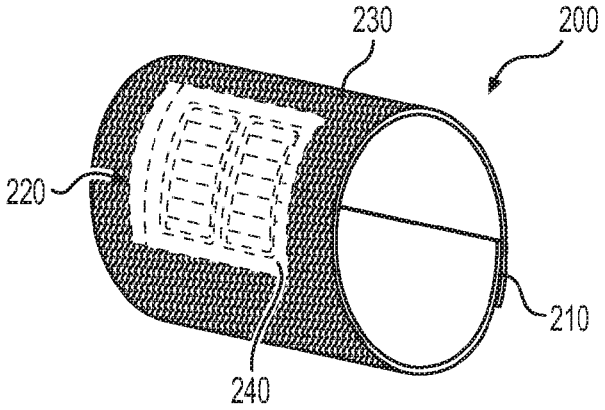
FIG. 14 is a top perspective view of the magnetic wrist band laid out according to an embodiment of the present invention.

In another alternative embodiment the magnetic tool holder shown in FIG. 14, a magnetic wrap 200 comprises attachment means 210, such as clamps, clips, loops or straps to allow a user to wear the device on a wrist, waist, arm, hip, thigh, chest or other body area (not shown), a strap 230, and an interior magnetic portion 220. The attachment means 210 of the strap 230 is illustrated as a hook and loop material arrangement for attachment of the holder to a body area (not shown). The set of magnets 240 could be in parallel along the body area (not shown), or could be in juxtaposition perpendicular to the body area. The strap 230 being made of a flexible material to conform to the contours of the body area.

Figure 15:
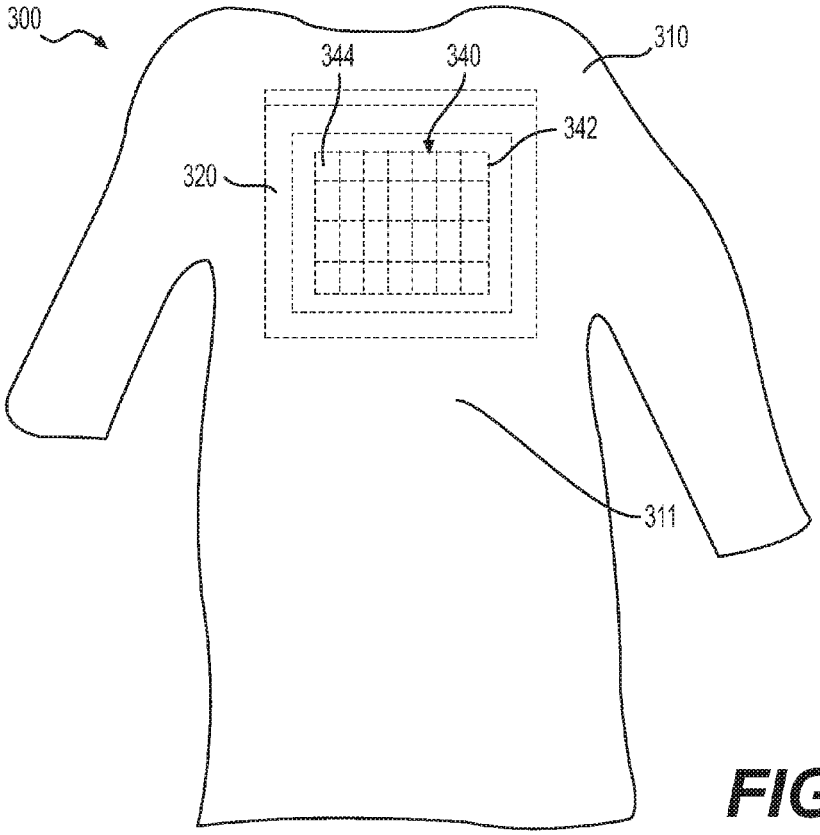
FIG. 15 is a top perspective view of the magnetic gown laid out according to an embodiment of the present invention.

In accordance with another embodiment of the present invention, FIG. 15 illustrates a gown 300 having a gown portion 310 and a magnetic attractive portion 320. The magnetic attractive portion 320 is defined by a plurality of magnets 340 within pockets 342 disposed in an array 342 such that each magnet 344 is contiguous with another magnet 344, as described above. The magnetic attractive portion 320 of the gown 300 functions in a similar manner as the interior magnet holding portion 7 of harness 1 as described above. The gown portion 310 may include a pockets (not shown) and/or loop(s) (not shown) which are attached to the front outer surface 311 of the gown portion 310 to hold various objects such as plastic or non-metallic parts, rubber gloves, pens, wooden objects such as pencils, or measuring devices such as rulers. In the preferred embodiment, the magnetic portion 320 is attached on the interior of the gown, but it is foreseen that the magnetic portion 320 may be attached on the exterior of clothing, as well.

Figure 16:
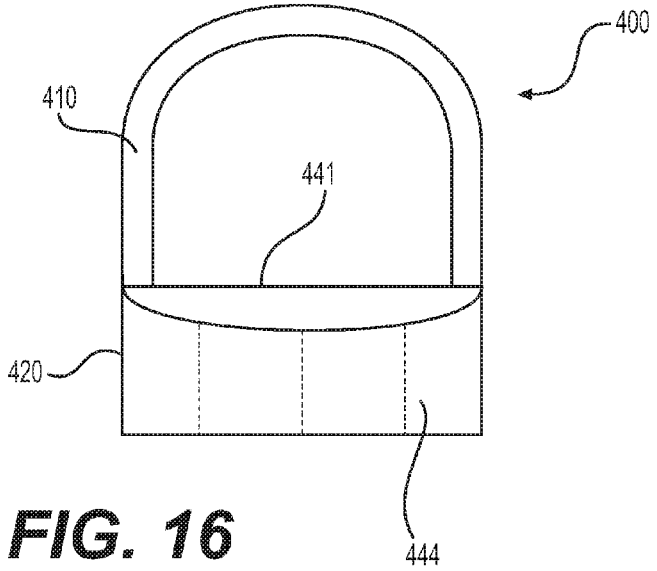
FIG. 16 is a top perspective view of the magnetic necklace laid out according to an embodiment of the present invention.

In accordance with another embodiment of the present invention, FIG. 16 illustrates a necklace 400 having a chain 410 and a magnetic attractive portion 420. The chain 410 being sized to go around the neck of a wearer. The magnetic attractive portion 420 is defined by a plurality of magnets 440 disposed in an array 442 in a pocket 441, such that each magnet 444 is contiguous with another magnet 444, as described above. The magnetic attractive portion 420 of necklace 400 functions in a similar manner as the interior magnet holding portion 7 of harness 1 as described above.

It is foreseen that the magnetic tool holder may be other embodiments such as cottonoid holders, vests, tool belts, etc., each foreseen to be adjustable in size and fit due to a fastening system.

Figure 17:
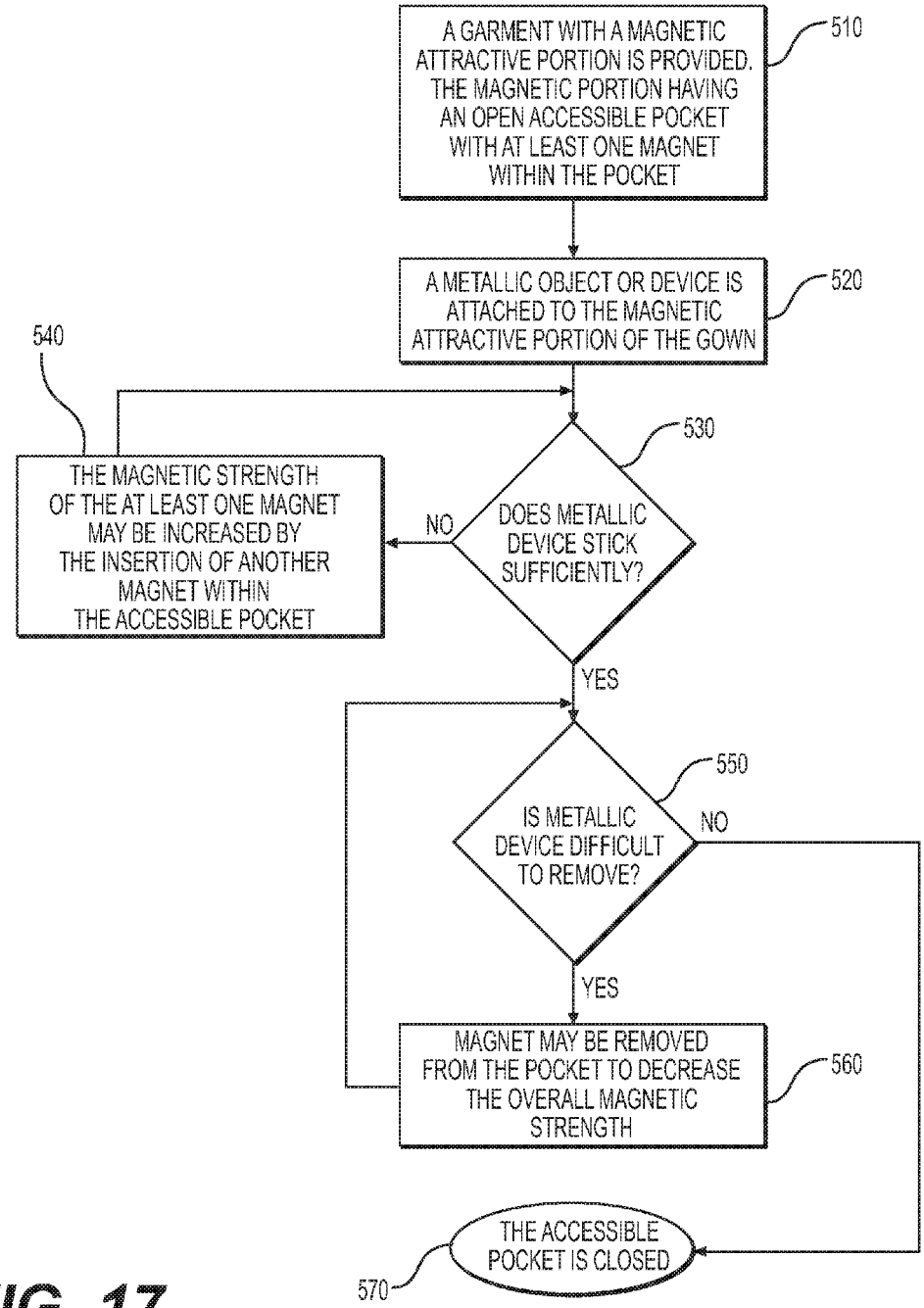
FIG. 17 is a method of affecting the magnetic strength of the magnetic portion of the magnetic holding garment according to the present invention.

Referring to FIG. 17, a method 500 of affecting the magnetic field strength of a magnet in a magnet holding garment is illustrated. At step 510, a garment with a magnetic attractive portion is provided. The magnetic portion having an open accessible pocket with at least one magnet within the pocket. At step 520, a metallic object or device is attached to the magnetic attractive portion of the garment. At step 530, if the metallic device does not stick to the magnet portion, then at step 540, the magnetic strength of the at least one magnet may be increased by the insertion of another second magnet within the accessible pocket. It is foreseen that step 540 may include adding a second magnet atop the at least one magnet or by affixing the magnets side by side. At step 550, if the metallic device is stuck to the magnetic portion of the garment, but is determined to be difficult to remove, then at step 560, a magnet may be removed from the pocket to adjust the overall strength of the magnets within the pocket. At step 570, the accessible pocket is closed. It is foreseen that the strengths of first and second magnets do not need to be the same. It is foreseen that the magnetic portion may include more than a single pocket to hold sets of magnets. It is foreseen that the method 500 may further include a step of removing the metallic object.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments.

It is to be understood that while certain forms of the present invention have been illustrated and described herein, it is not to be limited to the specific forms or arrangement of parts described and shown.

What is claimed and desired to be secured by Letters Patent is as follows:

1. A garment, comprising a magnetic portion having at least one resealable pouch housing at least one magnet, the pouch having an internal surface being sized and shaped to receive within said pouch a plurality of magnets situated in at least one of: (a) along a longitudinal axis and stacked so as to engage one another and (b) traverse the longitudinal axis and side by side so as to engage one another; wherein the pouch further includes a sealable water resistant layer that couples to the internal surface of the pouch, and wherein the sealable water resistant layer maintains an alignment of the plurality of magnets.

2. The garment of claim 1, wherein the plurality of magnets form a magnetic engagement surface to support a metallic object.

3. The garment of claim 1, wherein the at least one magnet is selected from a group consisting of square, rectangular, and circular magnets.

4. The garment of claim 1, wherein the at least one magnet is selected from the group consisting of permanent magnets, ferromagnets, alnico magnets, rare earth magnets, injection molded magnets, flexible magnets, ceramic magnets, and electromagnets.

5. The garment of claim 1, wherein the magnet includes a fastening means to couple to the internal surface of the pouch.

6. The garment of claim 1, wherein like poles align about the longitudinal axis.

7. The garment of claim 1, further comprising a fastener.

8. The garment of claim 7, wherein a belt is coupled to the fastener.

9. The garment of claim 1, wherein the magnetic portion is located on an inner surface of the garment.

10. The garment of claim 1, wherein the magnetic portion is located on an outer surface of the garment.

11. The garment of claim 1, further comprising a plurality of external pockets of various shapes and sizes.

12. The garment of claim 1, further comprising a clip on an outer surface of the garment.

13. The garment of claim 1, further comprising a loop on an outer surface of the garment.

14. A method of affecting the magnetic strength of a magnet in a magnet holding garment, comprising:

a. providing a garment with a magnetic attractive portion, the magnetic portion having an open accessible pocket with at least one magnet within the pocket, and a sealable water resistant layer that couples to an internal surface of the pocket, and wherein the sealable water resistant layer maintains an alignment of the at least one magnet;

b. manipulating the magnetic strength of the at least one magnet within the pocket;

c. attaching a metallic object to the magnetic attractive portion of the gown.

15. The method of claim 14, wherein step b further comprises adding a second magnet to the at least one magnet in of at least one: an over-under configuration and a side by side configuration.

16. The method of claim 15, wherein at least one magnet is removed from the at least one magnet and second magnet within the pocket.

17. The method of claim 15, wherein the second magnet has a different strength than the at least one magnet within the pocket.

18. The method of claim 14, wherein the magnetic attractive portion includes a second pocket.

* * * * *